US006053712A

United States Patent [19]

Konishi et al.

[11] Patent Number: 6,053,712

[45] **Date of Patent: *Apr. 25, 2000**

[54] CYLINDER INJECTION HIGH-PRESSURE FUEL PUMP

[75] Inventors: Keiichi Konishi; Yoshihiko Onishi, both of Tokyo, Japan

[73] Assignee: Mitsubishi Denki Kabushiki Kaisha, Tokyo, Japan

[ * ] Notice: This patent is subject to a terminal disclaimer.

[21] Appl. No.: 09/064,068

[22] Filed: Apr. 22, 1998

[30] Foreign Application Priority Data

Oct. 27, 1997 [JP] Japan ..... 9-294558

[51] Int. Cl.[7] ..... F04B 11/00

[52] U.S. Cl. ..... 417/540; 417/309; 417/311; 417/542; 123/446; 123/450; 123/506; 123/447; 138/30

[58] Field of Search ..... 417/309, 311, 417/540, 542; 123/446, 450, 506, 447; 138/30

[56] References Cited

U.S. PATENT DOCUMENTS

| | | | |
|---|---|---|---|
| 3,334,679 | 8/1967 | Bruning et al. . | |
| 4,118,156 | 10/1978 | Ivosevic . | |
| 4,201,522 | 5/1980 | Toyota et al. | 417/311 |
| 4,378,774 | 4/1983 | Kato | 123/446 |
| 4,523,612 | 6/1985 | Kuklo | 138/30 |
| 4,708,116 | 11/1987 | Gaa et al. | 123/506 |
| 4,870,939 | 10/1989 | Ishikawa et al. | 123/506 |
| 5,015,160 | 5/1991 | Hlousek et al. . | |
| 5,257,606 | 11/1993 | Willman et al. | 123/447 |
| 5,318,001 | 6/1994 | Djordjevic | 123/450 |
| 5,353,754 | 10/1994 | Wissmann et al. . | |
| 5,404,855 | 4/1995 | Yen et al. . | |

FOREIGN PATENT DOCUMENTS

| | | |
|---|---|---|
| 685 644 | 12/1995 | European Pat. Off. . |
| 44 01 083 | 7/1995 | Germany . |
| 195 108 | 7/1997 | Germany . |
| 7-12029 | 1/1995 | Japan . |
| 7-83134 | 3/1995 | Japan . |
| 2 307 280 | 5/1997 | United Kingdom . |
| WO 97/08454 | 3/1997 | WIPO . |

*Primary Examiner*—John A. Jeffery
*Assistant Examiner*—Leonid Fastovsky
*Attorney, Agent, or Firm*—Sughrue, Mion, Zinn, Macpeak & Seas, PLLC

[57] ABSTRACT

A cylinder injection high-pressure fuel pump prevents the pulsations of fuel generated by a high-pressure fuel pump from spreading to a low-pressure pipe connected to a low pressure end. The cylinder injection high-pressure fuel pump has: a casing (1) in which an inlet passage (2) for taking fuel in and a discharge passage (35) for draining the fuel are formed; a cylinder (30) formed in the casing (1); a fuel pressurizing chamber (32) formed in a part of the cylinder (30); and a plunger (31) disposed in the cylinder (30) such that is may reciprocate therein. As the plunger (31) reciprocates, the fuel is taken into the fuel pressurizing chamber (32) through the inlet passage (2)and pressurized therein, then the pressurized fuel is discharged through the discharge passage (35) and forcibly fed into a fuel injector of a cylinder injection type engine. The inlet passage (2) is equipped with a check valve (70).

5 Claims, 5 Drawing Sheets

CYLINDER INJECTION HIGH-PRESSURE FUEL PUMP

BACKGROUND OF THE INVENTION

1. Field of the Invention

The present invention relates to a high-pressure fuel pump for a cylinder injection type engine and, more particularly, to a cylinder injection high-pressure fuel pump which prevents pulsations from spreading to a low-pressure pipe.

2. Description of Related Art

A diesel engine has been widely known as an engine designed to inject fuel in the cylinders of the engine which is referred to as a cylinder injection engine or a direct injection engine. In recent years, the cylinder injection type has been proposed also for a spark ignition engine or a gasoline engine. In such a cylinder injection engine, a fuel pressure of approximately 5 MPa, for example, is necessary because the fuel is injected into a cylinder during the compression stroke of the cylinder, whereas the fuel pressure is approximately 0.3 MPa in the case of a conventional engine wherein a fuel-air mixture is produced outside a cylinder.

To obtain such a high fuel pressure, a high-pressure fuel pump is generally provided on the side of a fuel injector in addition to a low-pressure fuel pump provided in a fuel tank. In general, the low-pressure fuel pump is driven by, for example, a motor or the like and it is driven at all times as long as the power is ON, while the high-pressure fuel pump is driven by an engine and it runs as the engine runs. The high-pressure fuel pump is provided with a pulsation absorber to absorb the pulsation that takes place in the pipe at the low pressure end so as to stabilize the discharge of the high-pressure fuel pump.

FIG. 9 is a side view illustrating a conventional high-pressure fuel pump, a part thereof being shown in a sectional view; and FIG. 10 is a system diagram of the pulsation absorber on the low pressure end. In the drawings, a high-pressure fuel pump assembly 100 has a casing 1, a cylinder 30 being provided at the bottom of the casing 1; and a plunger 31 is provided in the cylinder 30 such that it is able to reciprocate therein. The cylinder 30 and the plunger 31 constitute a fuel pressurizing chamber 32.

Formed on one side surface of the casing 1 is an inlet port 14 to which a low pressure pipe (not shown) extending from the low-pressure fuel pump is connected. An inlet passage 2 is formed between the inlet port 14 and the fuel pressurizing chamber 32; a filter 8 is provided at the boundary of the inlet port 14 and the inlet passage 2. The fuel supplied from the low-pressure fuel pump is fed into the fuel pressurizing chamber 32 through the inlet passage 2. Formed also on one side surface of the casing 1 is a discharge port 34 to which a high pressure pipe (not shown) extending to a fuel injector is connected. A discharge passage 35 is formed between the discharge port 34 and the fuel pressurizing chamber 32; the fuel which has been pressurized in the fuel pressurizing chamber 32 passes through the discharge passages 35 to be discharged outside. A resonator 36 is provided in the middle of the discharge passage 35.

The plunger 31 reciprocates in the cylinder 30; it takes fuel into the fuel pressurizing chamber 32 where it pressurizes the fuel, then discharges it outside through the discharge passage 35. The high-pressure fuel pump assembly 100 is a single-cylinder type which has the single cylinder 30. Hence, oil impact occurs at every intake or discharge operation in the inlet passage 2 and the discharge passage 35, causing the fuel to pulsate. In particular, the pulsation taking place in the inlet passage 2 causes the outflow of the high-pressure fuel pump assembly 100 to drop and also causes the low pressure pipe connected to the inlet port 14 to vibrate, producing noises.

Formed on one side surface of the casing 1 is a low-pressure-end pulsation absorber 46 which has an approximately cylindrical sleeve 15 and a bottomed cylindrical piston 20 which is slidably disposed in the sleeve 15. The piston 20 is urged by a spring 23 to the right in FIG. 9. The sleeve 15 and the piston 20 constitute a capacity chamber 25. The low-pressurceend pulsation absorber 46 is provided in the middle of the inlet passage 2; the capacity chamber 25 is in communication with the inlet port 14 through an inlet passage 2*a*, which is one counterpart making up the inlet passage 2, and it is connected with a fuel pressurizing chamber through an inlet passage 2*b*, which is the other counterpart making up the inlet passage 2.

The low-pressure-end pulsation absorber 46 moves the piston 20 according to the change in fuel pressure so as to absorb the fuel pulsation produced at the high-pressure fuel pump 100. More specifically, the fuel supplied through the inlet passage 2*a* enters the capacity chamber 25, then moves through the inlet passage 2*b* toward the fuel pressurizing chamber. The fuel in the inlet passage 2*b* pulsates as the high-pressure fuel pump 100 takes in or discharges the fuel. At this time, the low-pressure-end pulsation absorber 46 moves the piston 20 to the left in FIG. 9 when the fuel pressure is high, while it moves the piston 20 to the right in FIG. 9 when the fuel pressure is low, thereby absorbing the pulsation of the fuel in the inlet passage 2.

The fuel pulsation generated by the high-pressure fuel pump, however, has not been completely removed even when the low-pressure-end pulsation absorber 46 is provided. The pulsation that the pulsation absorber has failed to remove reaches a low-pressure pipe (not shown) which is connected to the inlet port 14 and which extends to a fuel tank across a car body. The pulsation spread to the low-pressure pipe has been posing a problem in that it vibrates the low-pressure pipe, causing abnormal noises.

SUMMARY OF THE INVENTION

The present invention has been made with a view toward solving the problems mentioned above, and it is an object of the present invention to provide a cylinder injection high-pressure fuel pump which prevents pulsations generated by the high-pressure fuel pump from spreading to a low-pressure pipe connected to the low pressure end.

To this end, according to one aspect of the present invention, there is provided a cylinder injection high-pressure fuel pump having: a casing in which an inlet passage for taking in fuel and a discharge passage for discharging fuel are formed, a cylinder formed in the casing, a fuel pressuring chamber formed in a part of the cylinder, and a plunger disposed in the cylinder so that it may reciprocate therein; wherein the reciprocating motion of the plunger causes the fuel to be taken through the inlet passage into the fuel pressurizing chamber where it is pressurized, and the pressurized fuel is discharged through the discharge passage and forcibly fed to a fuel injector of the cylinder injection type engine, and the inlet passage is provided with a check valve.

According to another aspect of the present invention, there is provided a cylinder injection high-pressure fuel pump having: a casing in which an inlet passage for taking in fuel and a discharge passage for discharging fuel are formed, a cylinder formed in the casing, a fuel pressurizing chamber formed in a part of the cylinder, and a plunger disposed in the cylinder so that it may reciprocate therein; wherein the reciprocating motion of the plunger causes the fuel to be taken through the inlet passage into the fuel pressurizing chamber where it is pressurized, and the pressurized fuel is discharged through the discharge passage and forcibly fed to a fuel injector of the cylinder injection engine; wherein a low-pressure-end pulsation absorber is provided which has a capacity chamber formed by enlarging a part of the inlet passage, and a sealed vessel which is housed in the capacity chamber and which has a gas hermetically sealed therein to change the volume thereof according to a change in the pressure of the capacity chamber, and a check valve is provided on the upstream end from the low-pressure-end pulsation absorber of the inlet passage.

In a preferred form of the cylinder injection high-pressure fuel pump according to the present invention, the check valve is a reed valve.

In another preferred form of the cylinder injection high-pressure fuel pump according to the present invention, the check valve is a ball valve.

In a further preferred form of the cylinder injection high-pressure fuel pump according to the present invention, the check valve is provided with an orifice.

In a further preferred form of the cylinder injection high-pressure fuel pump according to the present invention, the orifice is the passage aperture formed in the reed valve.

DESCRIPTION OF THE PREFERRED EMBODIMENTS

First Embodiment

Figure 1:
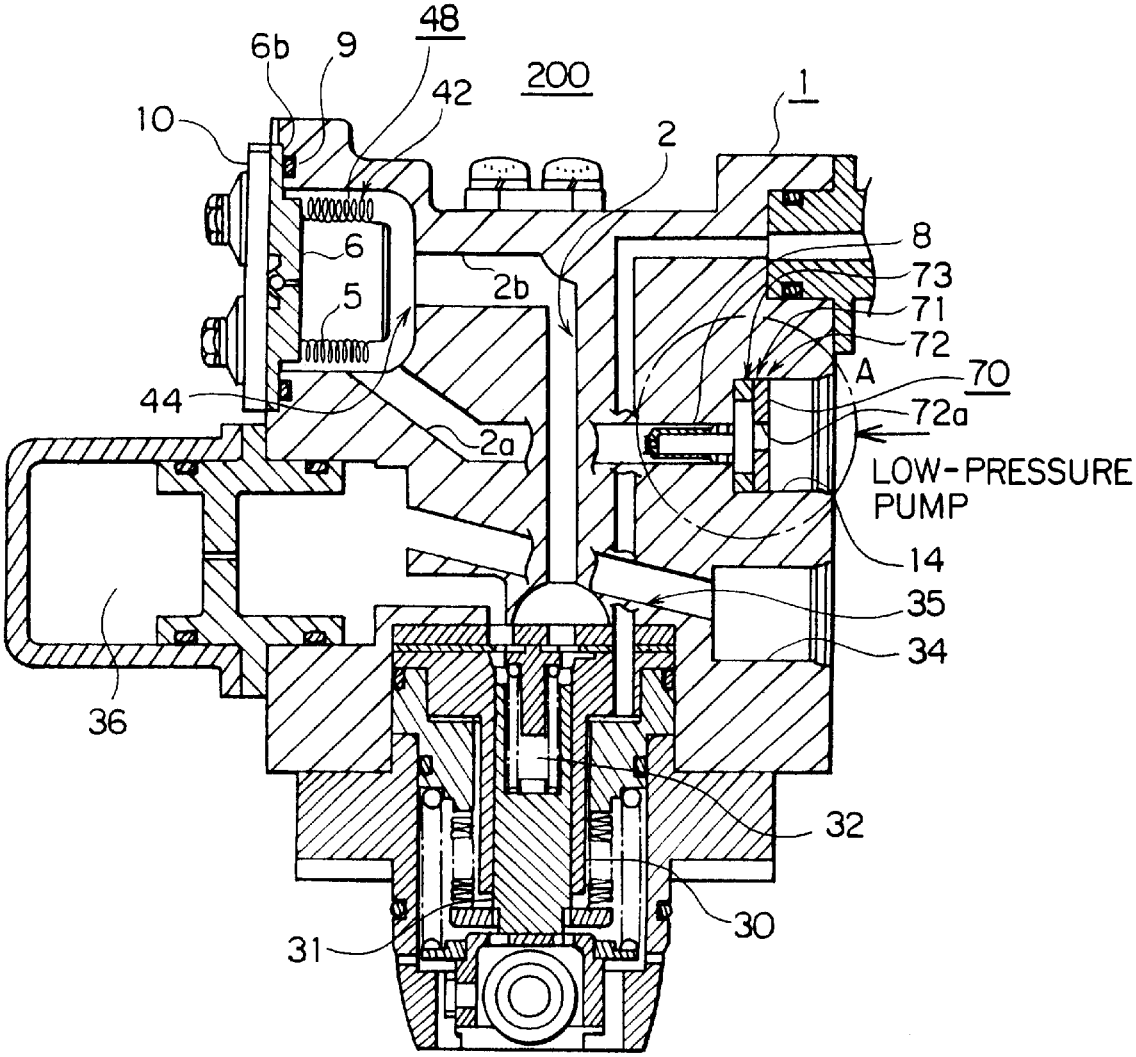
FIG. 1 is a side view illustrating a cylinder injection high-pressure fuel pump in accordance with the present invention, a part thereof being shown in a sectional view.
Figure 2:
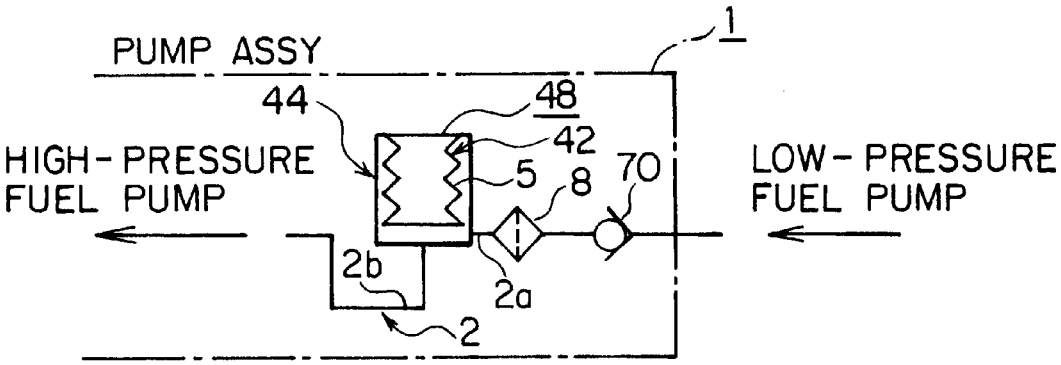
FIG. 2 is a system diagram showing a part of the cylinder injection high-pressure fuel pump.
Figure 3:
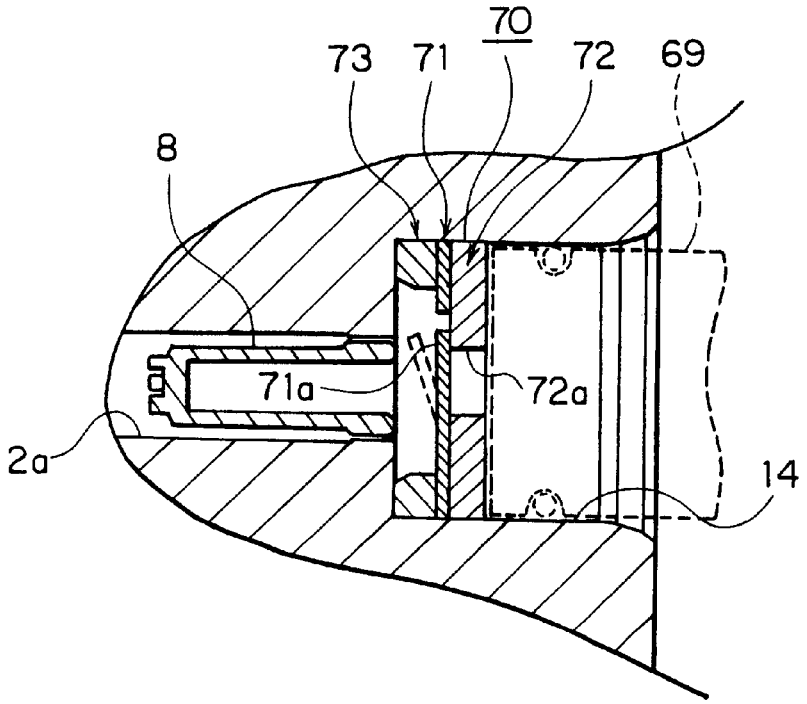
FIG. 3 is an enlarged view of portion A of FIG. 1.

FIG. 1 is a side view illustrating a cylinder injection high-pressure fuel pump in accordance with the present invention, a part thereof being shown in a sectional view; FIG. 2 is a system diagram of a part of the cylinder injection high-pressure fuel pump; and FIG. 3 is an enlarged view of portion A of FIG. 1. In FIG. 1 through FIG. 3, a high-pressure fuel pump 200 has a casing 1, a cylinder 30 being provided at the bottom of the casing 1; and a plunger 31 is provided in the cylinder 30 such that it is able to reciprocate therein. The cylinder 30 and the plunger 31 constitute a fuel pressurizing chamber 32 which pressurizes fuel.

Formed on one side surface of the casing 1 is an inlet port 14 to which a low pressure pipe 69 extending from the low-pressure fuel pump is connected. An inlet passage 2 is formed between the inlet port 14 and the fuel pressurizing chamber 32; a filter 8 is provided at the boundary of the inlet port 14 and the inlet passage 2. The fuel supplied from the low-pressure fuel pump passes through the low-pressure pipe 69 to the high-pressure fuel pump 200, and it further passes through the inlet passage 2 to be fed into the fuel pressurizing chamber. Formed also on one side surface of the casing 1 is a discharge port 34 to which a high pressure pipe extending to a fuel injector is connected. A discharge passage 35 is formed between the discharge port 34 and the fuel pressurizing chamber 32; the fuel which has been pressurized in the fuel pressurizing chamber 32 passes through the discharge passages 35 to be drained outside. A resonator 36 is provided in the middle of the discharge passage 35.

The plunger 31 reciprocates in the cylinder 30; it takes fuel into the fuel pressurizing chamber 32 where it pressurizes the fuel, then discharges it outside through the discharge passage 35. The high-pressure fuel pump 200 is a single-cylinder type which has the single cylinder 30. Hence, oil impact occurs at every intake or discharge in the inlet passage 2 or the discharge passage 35, causing the fuel to pulsate.

Formed on the other side surface of the casing 1 is a low-pressure-end pulsation absorber 48 which is comprised of a capacity chamber 44 formed by enlarging a part of the inlet passage 2, and a sealed vessel 42 disposed inside the capacity chamber 44. The sealed vessel 42 is comprised of bottomed cylindrical metal bellows 5 which is made of stainless steel and the cylindrical section of which is made of bellows, and an approximately disc-shaped base member 6 which hermetically seals the opening of the metal bellows 5 and which is also made of stainless steel. The opening of the metal bellows 5 is secured by welding to the main surface of the base member 6. Sealed inside the sealed vessel 42 is air of atmospheric pressure. The sealed vessel 42 is fixed in the capacity chamber 44 with a flange **6*b* formed on the outer periphery of the base member 6 being-held by a plate 10, and it is hermetically sealed by an O ring 9. The low-pressure-end pulsation absorber 48 is provided in the middle of the inlet passage; the capacity chamber 44 is in communication with the inlet port 14 through the inlet passage 2*a*, which is a counterpart of the inlet passage 2, and it is also connected with the fuel pressurizing chamber 32 through the other counterpart 2*b* of the inlet passage 2**.

The low-pressure-end pulsation absorber 48 expands or contracts the metal bellows 5 in response to a change in the fuel pressure so as to absorb the fuel pulsation produced by the high-pressure fuel pump. To be more specific, the fuel supplied through the inlet passage **2*a* goes into the capacity chamber 44, then it passes through the inlet passage 2*b* into the fuel pressurizing chamber 32. The flow of the fuel in the inlet passage 2*b* pulsates as the high-pressure fuel pump 200 takes in or discharges the fuel. The low-pressure-end pulsation absorber 48 contracts the metal bellows 5 to the left in FIG. 1 when the fuel pressure is high, while it expands the metal bellows 5 to the right in FIG. 1 when the fuel pressure is low, thereby absorbing the pulsation of the fuel flow in the inlet passage 2. The metal bellows type low-pressure-end pulsation absorber 48 has better responsiveness than a conventional piston type low-pressure end pulsation absorber and it is able to securely absorb high-frequency pulsations such as a surge pressure; however, it is not able to fully absorb low-frequency pulsations because the sealed vessel 42** has a small amount of gas sealed therein and the changeable volume is accordingly small.

Figure 4:
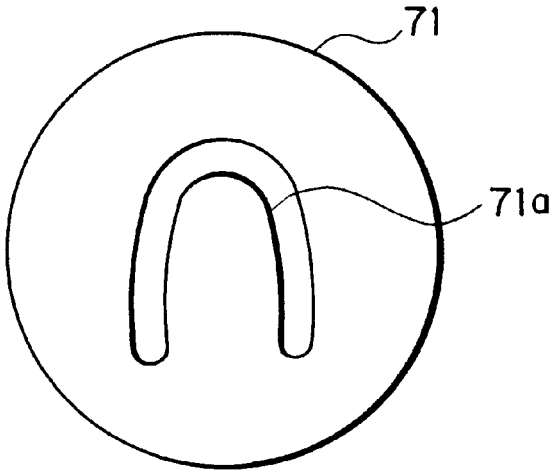
FIG. 4 is a front view of a reed valve.

The inlet port 14 is formed in an approximately cylindrical recessed section, a check valve 70 is provided at the bottom of the inlet port 14. The check valve 70 is composed of a reed valve 71 made of a thin stainless sheet, a valve seat 72 having a through hole 72*a*, through which fuel passes, at the center thereof, and a ring 73 which holds, together with the valve seat 72, the outer periphery of the reed valve 71. As shown in FIG. 4, the reed valve 71 has a valve disc 71*a* formed at the center thereof. The check valve 70 is press-fitted at the bottom of the inlet port 14, the reed valve 71, the valve seat 72, and the ring 73 being stacked. The size of the valve disc 71*a* matches that of the through hole 72*a* so as to close the through hole 72*a*. The valve disc 71*a* bends as indicated by the dashed line in FIG. 3 to let fuel pass when the fuel which has come through the through hole 72*a* applies a predetermined pressure. The low-pressure pipe 69 is connected to the inlet port 14 located outward from the check valve 70 such that it abuts against the check valve 70 as indicated by the dashed line.

In the cylinder injection high-pressure fuel pump having such a configuration, the check valve 70 allows fuel to flow only in one direction from the low-pressure pipe 69 to the inlet passage 2. The impact of oil generated by the high-pressure fuel pump 200 is suppressed by the check valve 70 so as to prevent the pulsation pressure of the fuel from reaching the low-pressure pipe 69. Thus, the low-pressure pipe 69 does not vibrate and no abnormal noises are produced.

Moreover, low-frequency pulsations that cannot be absorbed by the low-pressure-end pulsation absorber 48 are prevented by the check valve 70 from spreading to the low-pressure pipe 69. Thus, low-frequency pulsations can be effectively prevented from affecting the low-pressure pipe 69.

In addition, since the check valve 70 employs a reed valve, it can be made thinner, permitting it to be compactly housed in the inlet port 14. This enables the check valve to be disposed without requiring a major design change, and it also enables the high-pressure fuel pump 200 to be made smaller.

Second Embodiment

Figure 5:
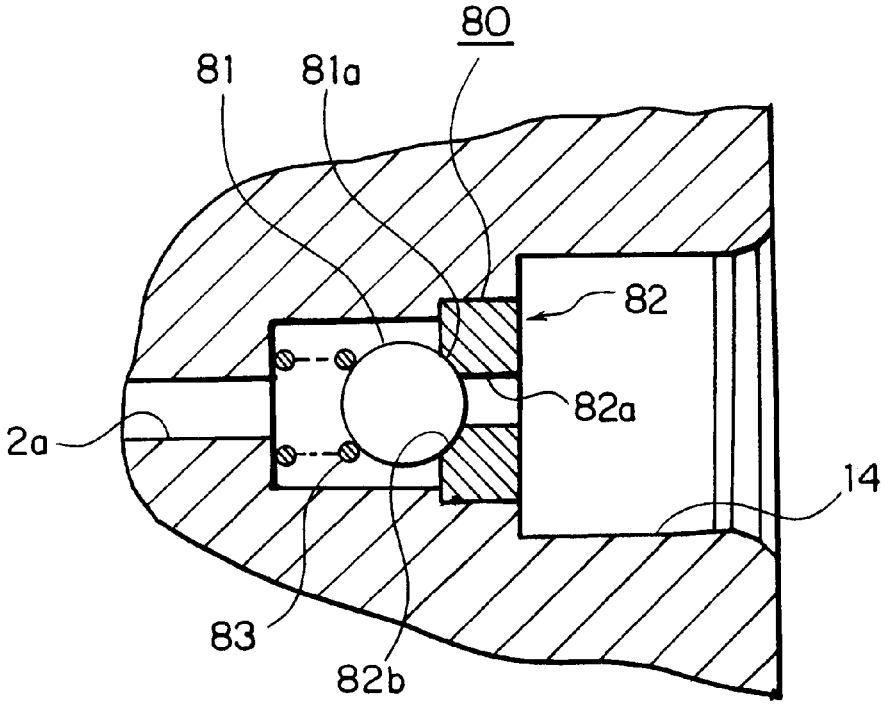
FIG. 5 is an enlarged view of an essential section in the vicinity of a check valve illustrating another cylinder injection high-pressure fuel pump in accordance with the present invention.

FIG. 5 is an enlarged view of an essential section around a check valve showing another example of the cylinder injection high-pressure fuel pump in accordance with the present invention. In this embodiment, a check valve 80 is a ball valve. The check valve 80 is comprised of a ball 81 which has a seat surface 81*a*, a valve seat 82 which has a through hole 82*a* at the center thereof and a seat 82*b* formed at one end of the through hole 82*a*, and a spring 83 which presses the seat surface 81*a* of the ball 81 against the seat 82*b*. The ball 81 moves to the left in FIG. 5 to let fuel, which has been supplied through the through hole 82*a*, to pass when the fuel applies a predetermined pressure. In the check valve 80 having the configuration set forth above, the resistance of the passing fuel can be made extremely low by providing the spring 83 of an appropriate tension.

The rest of the configuration is identical to the configuration of the first embodiment.

In the cylinder injection high-pressure fuel pump having such-a configuration, the check valve 80 allows fuel only in one direction from the low-pressure pipe 69 to the inlet passage 2. The impact of oil generated by the high-pressure fuel pump is suppressed by the check valve 80 so as to prevent the pulsation pressure of the fuel from reaching the low-pressure pipe 69. Thus, the low-pressure pipe does not vibrate and no abnormal noises are produced.

In addition, since the check valve 80 is a ball valve, the passing resistance of the fuel can be reduced, leading to smaller loss of the fuel pressure.

Third Embodiment

Figure 6:
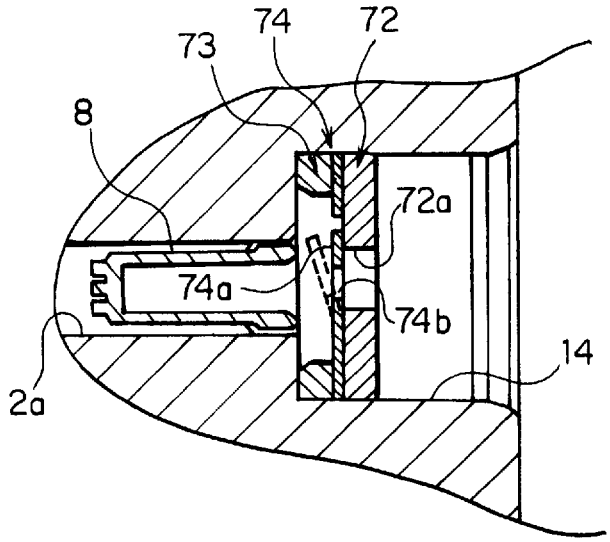
FIG. 6 is an enlarged view of an essential section in the vicinity of a check valve illustrating yet another cylinder injection high-pressure fuel pump in accordance with the present invention.
Figure 7:
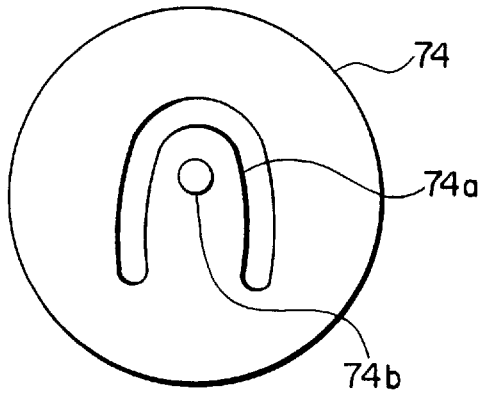
FIG. 7 is a front view of a reed valve.
Figure 8:
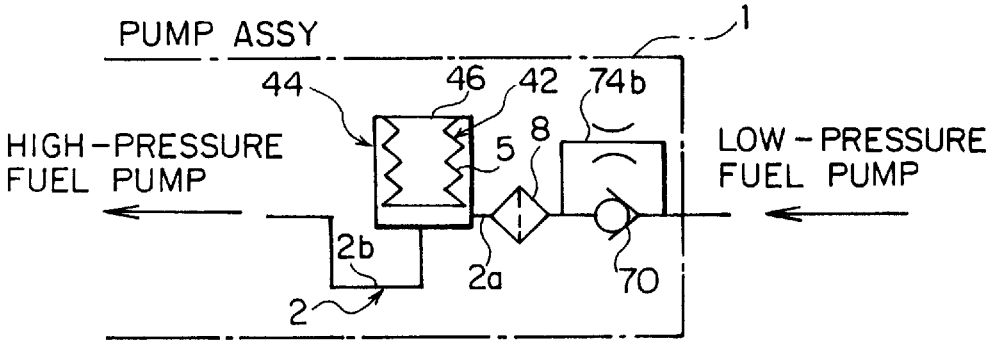
FIG. 8 is a system diagram showing a part of the cylinder injection high-pressure fuel pump.
Figure 9:
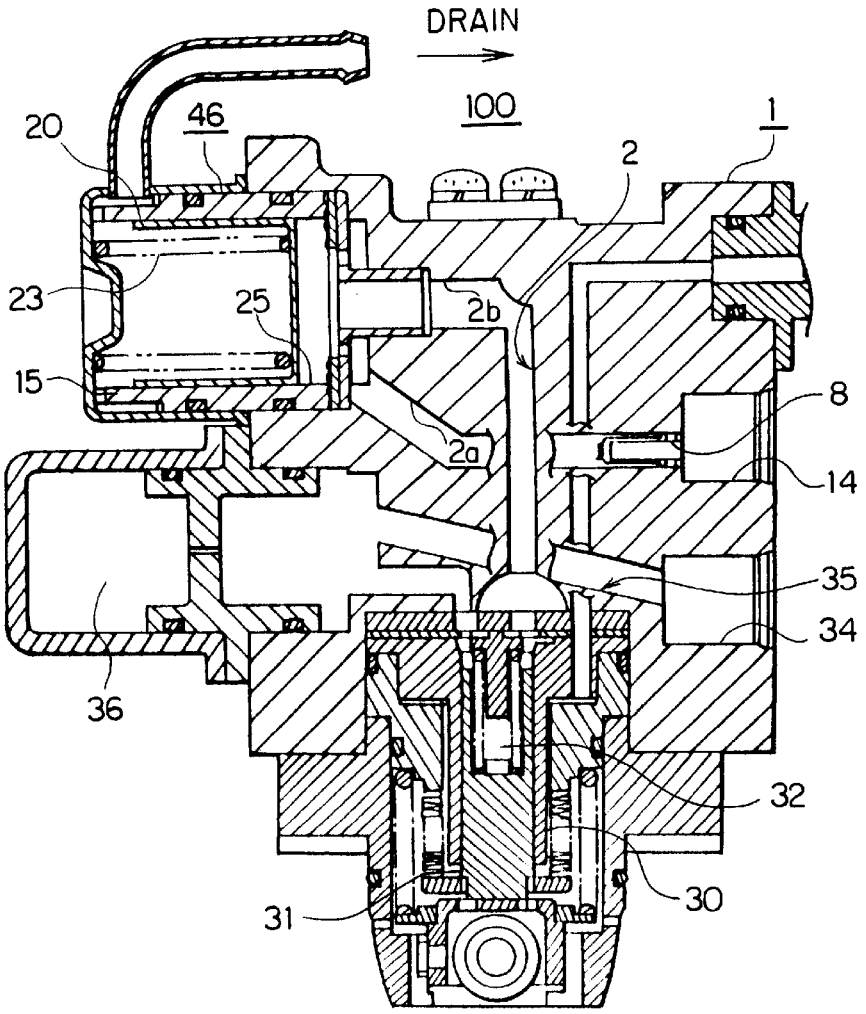
FIG. 9 PRIOR ART
FIG. 9 is a side view illustrating a conventional cylinder injection high-pressure fuel pump, a part thereof being shown in a sectional view.
Figure 10:
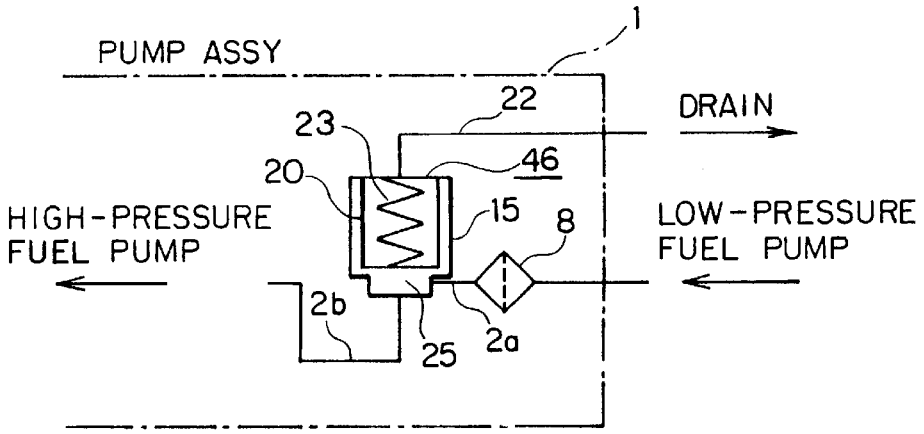
FIG. 10 PRIOR ART
FIG. 10 is a system diagram showing a part of the conventional cylinder injection high-pressure fuel pump.

FIG. 6 is an enlarged view of an essential section around a check valve of yet another example of a cylinder injection high-pressure fuel pump in accordance with the present invention; FIG. 7 is a front view of a reed valve; and FIG. 8 is a system diagram showing a part of the cylinder injection high-pressure fuel pump. In the third embodiment illustrated in FIGS. 6 through 8, a passage aperture 74*b*, which is an orifice, is provided at the center of a valve disc 74*a* of a reed valve 74. The rest of the configuration is identical to the configuration of the first embodiment.

In a fuel supply system having a high-pressure fuel pump and a low-pressure fuel pump, the high-pressure fuel pump is not in operation when the engine is started, so that the fuel is supplied to the engine only by the pressure of the low-pressure fuel pump. At this time, if the pressure of the low-pressure fuel pump is too small or the resistance of the check valve is too high, then the required pressure for the startup cannot be supplied. At high engine speed, more fuel must be supplied to the fuel pressurizing chamber 32; if the check valve restricts too much fuel, then inadequate fuel is supplied to the fuel pressurizing chamber 32 at high engine speed, resulting in reduced discharge of the high-pressure pump.

In the high-pressure fuel pump in the third embodiment, the passage aperture 74*b*, the orifice, provided at the center of the valve disc 74*a* of the reed valve 74 inevitably allows a very small pulsation to reach the low-pressure pipe 69; however, the fuel flow does not stop at the engine startup or the like when the fuel pressure is low. Moreover, when more fuel must be supplied in such a situation where the engine is running at high speed, the fuel flow can be increased. The pulsations spread to the low-pressure pipe 69 present no problem because they can be reduced to such an extent that they cause no abnormal noises.

The orifice is composed of the passage aperture 74*b* formed in the valve disc 74*a*, so that it can be formed easily by a simple structure.

The orifice in this embodiment is composed of the passage aperture 74*b* formed in the valve disc 74*a*; however, it is not limited thereto. As an alternative, for example, a small passage may be formed in the casing 1 such that fuel flows from the inlet port 14 to the inlet passage 2*a*, bypassing the check valve.

Thus, the cylinder injection high-pressure fuel pump in accordance with the present invention has: a casing in which an inlet passage for taking in fuel and a discharge passage for discharging fuel are formed, a cylinder formed in the casing, a fuel pressuring chamber formed in a part of the cylinder, and a plunger disposed in the cylinder so that it may reciprocate therein; wherein the reciprocating motion of the plunger causes the fuel to be taken through the inlet passage into the fuel pressurizing chamber where it is pressurized, and the pressurized fuel is discharged through the discharge passage and forcibly fed to a fuel injector of the cylinder injection type engine, and the inlet passage is provided with a check valve. Hence, the pulsation of fuel caused by the high-pressure fuel pump is prevented from spreading to the low-pressure pipe connected to the low pressure end.

The cylinder injection high-pressure fuel pump in accordance with the present invention has: a casing in which an inlet passage for taking in fuel and a discharge passage for discharging fuel are formed, a cylinder formed in the casing, a fuel pressuring chamber formed in a part of the cylinder, and a plunger disposed in the cylinder so that it may reciprocate therein; wherein the reciprocating motion of the plunger causes the fuel to be taken through the inlet passage into the fuel pressurizing chamber where it is pressurized, and the pressurized fuel is discharged through the discharge passage and forcibly fed to a fuel injector of the cylinder injection engine; a low-pressure-end pulsation absorber is provided which has a capacity chamber formed by enlarging a part of the inlet passage, and a sealed vessel which is housed in the capacity chamber and which has a gas hermetically sealed therein to change the volume thereof according to a change in the pressure of the capacity chamber, and a check valve is also provided on the upstream end from the low-pressure-end pulsation absorber of the inlet passage. Hence, the low-pressure-end pulsation absorber absorbs most fuel pulsations so as to prevent the check valve from allowing a very few low-frequency pulsations that cannot be absorbed by the low-pressure-end pulsation absorber to be transmitted to the low-pressure pipe. This makes it possible to effectively prevent the pulsations from spreading to the low-pressure pipe.

In the cylinder injection high-pressure fuel pump according to the present invention, the check valve is a reed valve. This enables the check valve to be made thinner and accordingly enables the high-pressure fuel pump to be made smaller.

In the cylinder injection high-pressure fuel pump according to the present invention, the check valve is a ball valve. This makes it possible to reduce the passing resistance of fuel and accordingly enables reduced loss of fuel pressure.

In the cylinder injection high-pressure fuel pump according to the present invention, the check valve is provided with an orifice. Hence, even when fuel pressure is low, the fuel flows. When more fuel must be supplied, the fuel flow can be increased.

In the cylinder injection high-pressure fuel pump according to the present invention, the orifice is the passage aperture formed in the reed valve. This makes it possible to form the orifice by a simple structure.

What is claimed is:

1. A cylinder injection high-pressure fuel pump having: a casing in which an inlet passage for taking in fuel and a discharge passage for discharging fuel are formed, a cylinder formed in said casing, a fuel pressurizing chamber formed in a part of said cylinder, and a plunger disposed in said cylinder so that it may reciprocate therein; wherein the reciprocating motion of said plunger causes the fuel to be taken through said inlet passage into said fuel pressurizing chamber where it is pressurized, and the pressurized fuel is discharged through said discharge passage and forcibly fed to a fuel injector of a cylinder injection engine;

wherein a low-pressure-end pulsation absorber is provided which has a capacity chamber formed by enlarging a part of said inlet passage, and a sealed vessel which is housed in said capacity chamber and which has a gas hermetically sealed therein to change the volume thereof according to a change in the pressure of said capacity chamber, and a check valve is provided on the upstream end from said low-pressure-end pulsation absorber of said inlet passage.

2. A cylinder injection high-pressure fuel pump according to claim 1, wherein said check valve is a reed valve.

3. A cylinder injection high-pressure fuel pump according to claim 1, wherein said check valve is a ball valve.

4. A cylinder injection high-pressure fuel pump according to claim 1, wherein said check valve is provided with an orifice.

5. A cylinder injection high-pressure fuel pump according to claim 4, wherein said orifice is a passage aperture formed in the reed valve.

* * * * *